US009011187B2

(12) United States Patent
Yang

(10) Patent No.: US 9,011,187 B2
(45) Date of Patent: Apr. 21, 2015

(54) ELECTRICAL CONNECTOR

(71) Applicant: Cheng Uei Precision Industry Co., Ltd., New Taipei (TW)

(72) Inventor: Chih Lin Yang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 92 days.

(21) Appl. No.: 14/018,405

(22) Filed: Sep. 4, 2013

(65) Prior Publication Data

US 2015/0064980 A1 Mar. 5, 2015

(51) Int. Cl.

| | |
|---|---|
| ***H01R 4/48*** | (2006.01) |
| ***H01R 13/405*** | (2006.01) |
| ***H01R 24/60*** | (2011.01) |
| ***H01R 13/516*** | (2006.01) |

(52) U.S. Cl.

CPC ..... *H01R 13/405* (2013.01); *H01R 24/60* (2013.01); *H01R 13/516* (2013.01)

(58) Field of Classification Search

CPC ..... H01R 13/6658; H01R 23/7073; H01R 13/2442

USPC ..... 439/862, 76.1, 660

See application file for complete search history.

(56) References Cited

U.S. PATENT DOCUMENTS

| | | | | | |
|---|---|---|---|---|---|
| 3,474,380 | A * | 10/1969 | Miller | 439/752 |
| 4,023,879 | A * | 5/1977 | Braund et al. | 439/76.1 |
| 4,553,192 | A * | 11/1985 | Babuka et al. | 361/743 |
| 4,645,279 | A * | 2/1987 | Grabbe et al. | 439/68 |
| 5,112,235 | A * | 5/1992 | Enomoto et al. | 439/83 |
| 5,791,929 | A * | 8/1998 | Banakis et al. | 439/342 |
| 6,494,748 | B1 * | 12/2002 | Mori et al. | 439/700 |
| 7,572,157 | B2 * | 8/2009 | Zhu | 439/862 |

* cited by examiner

*Primary Examiner* — Phuongchi T Nguyen

(74) *Attorney, Agent, or Firm* — Cheng-Ju Chiang

(57) ABSTRACT

An electrical connector includes an insulating body defining a mating face, and a plurality of terminals each having a base strip which is embedded in the insulating body. A front end of the base strip is bent towards the mating face to form a bend. A free end of the bend extends in a direction substantially parallel to the mating face to form a connecting arm. The connecting arm perpendicularly protrudes towards the mating face to form a contact arm. The bend, the connecting arm and the contact arm are embedded in the insulating body. A face of the contact arm opposite to the connecting arm is defined as a contact face exposed outside the mating face. It is smooth at the connection of the bend and the connecting arm, and there is a step between the contact face of the contact arm and the bend.

14 Claims, 9 Drawing Sheets

ELECTRICAL CONNECTOR

BACKGROUND OF THE INVENTION

Field of the Invention

The present invention relates to a connector, and more particularly to an electrical connector.

The Related Art

Nowadays, electrical connectors are widely used to realize signal transmission between electronic products and corresponding peripheral equipments thereof. Referring to FIG. 1, a conventional electrical connector includes a plurality of terminals 10' and an insulating body 20'. The terminal 10' has a base strip 11', a contact arm 13' and a soldering tail 14'. The contact arm 13' is connected with a front end of the base strip 11' by a bend 12', wherein it is smooth at the connection of the bend 12' and the contact arm 13'. A rear end of the base strip 11' is bent and then extends rearward to form the soldering tail 14'. In manufacture, the terminals 10' are placed in an injection molding machine (not shown) with contact faces 131' of the contact arms 13' being against an inner side of a shaping cavity (not shown) of the injection molding machine, then plastic material is injected into the injection molding machine to mold the insulating body 20' and the terminals 10' together. In detail, the base strip 11', the bend 12' and the contact arm 13' are embedded in the insulating body 20' with the contact face 131' of the contact arm 13' being exposed outside a mating face 21' of the insulating body 20', and the soldering tail 14' has a distal end thereof project behind the insulating body 20'.

However, in the process of plastic insert molding, because it is smooth at the connection of the bend 12' and the contact face 131' of the contact arm 13', if injection speed of the plastic material is excessively fast to cause a great injection force, the plastic material is apt to burst through the contact face 131' of the contact arm 13' from the inner side of the shaping cavity along the smooth bend 12' and further flood between the contact face 131' and the inner side of the shaping cavity to finally bring about burrs around the contact face 131'. Given this, the injection force of the plastic material is forced to reduce by means of slowing the injection speed. However, the slowing of the injection speed of the plastic material directly influences the flow of the plastic material in other runners of the injection molding machine or the molding time of the insulating body 20' etc. In order to solve the problem that there are injection molding bugs on the electrical connector caused by the inserts (namely the terminals 10'), an improved electrical connector is required.

Furthermore, the foregoing electrical connector in FIG. 1 is often mated with a mating connector in a single direction for insertion. As a result, users often need to recognize positive and negative directions of the electrical connector firstly before using the electronic connector. It is inconvenient for the users. Therefore, an electrical connector capable of overcoming the foregoing problems is required.

SUMMARY OF THE INVENTION

An object of the present invention is to provide an electrical connector. The electrical connector includes an insulating body of which at least one of a top face and a bottom face is defined as a mating face, and a plurality of terminals molded in the insulating body by plastic insert molding. Each of the terminals has a base strip embedded in the insulating body. A front end of the base strip is bent towards the mating face to form a bend. A free end of the bend extends in a direction substantially parallel to the mating face to form a connecting arm. The connecting arm perpendicularly protrudes towards the mating face to form a contact arm extending along a direction of the connecting arm. The bend, the connecting arm and the contact arm are embedded in the insulating body. A face of the contact arm opposite to the connecting arm is defined as a contact face exposed outside the mating face of the insulating body. A rear end of the base strip extends to form a soldering tail of which a distal end projects behind the insulating body. It is smooth at the connection of the bend and the connecting arm of the terminal, and there is a step between the contact face of the contact arm and the bend of the terminal.

As described above, the contact arm is perpendicularly protruded towards the mating face on the connecting arm to form the step between the contact face and the bend, so that effectively avoid burrs forming around the contact face of the terminal in the process of the plastic insert molding and solve injection molding bugs on the electrical connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
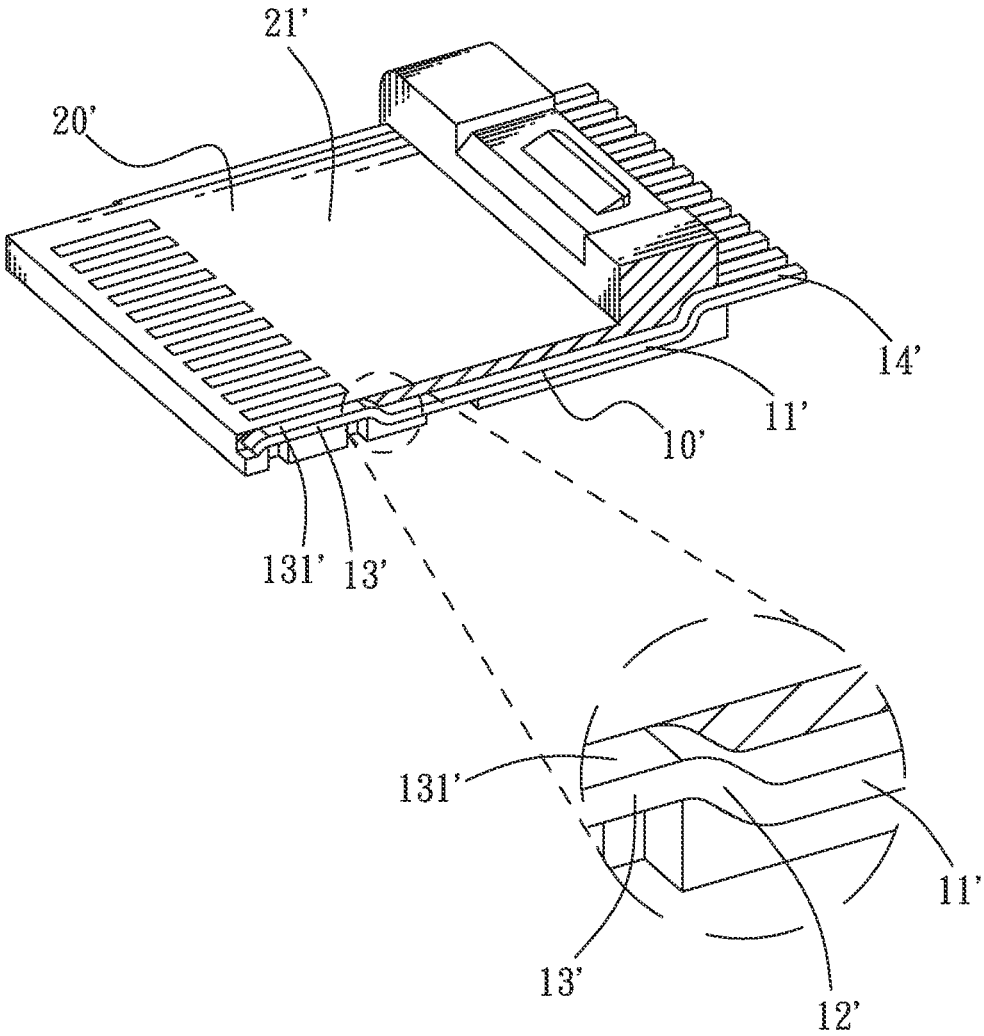
FIG. 1 (Prior Art)
FIG. 1 is a sectional view of a conventional electrical connector, wherein a circled part is enlarged.
Figure 2:
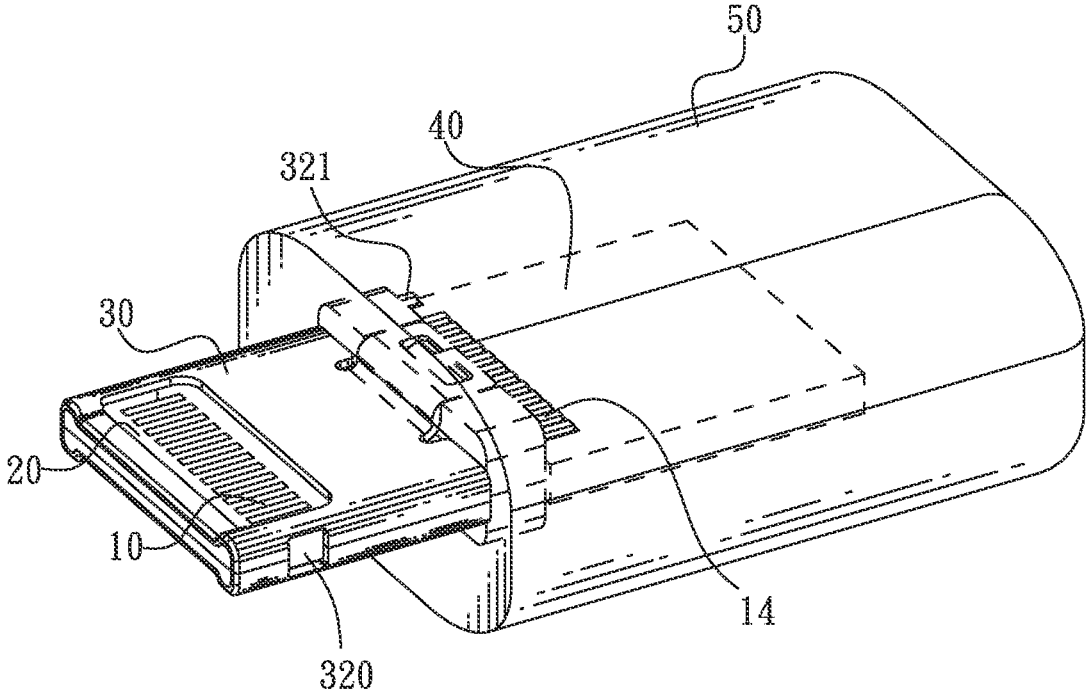
FIG. 2 is a perspective view of an electrical connector in accordance with an embodiment of the present invention.
Figure 3:
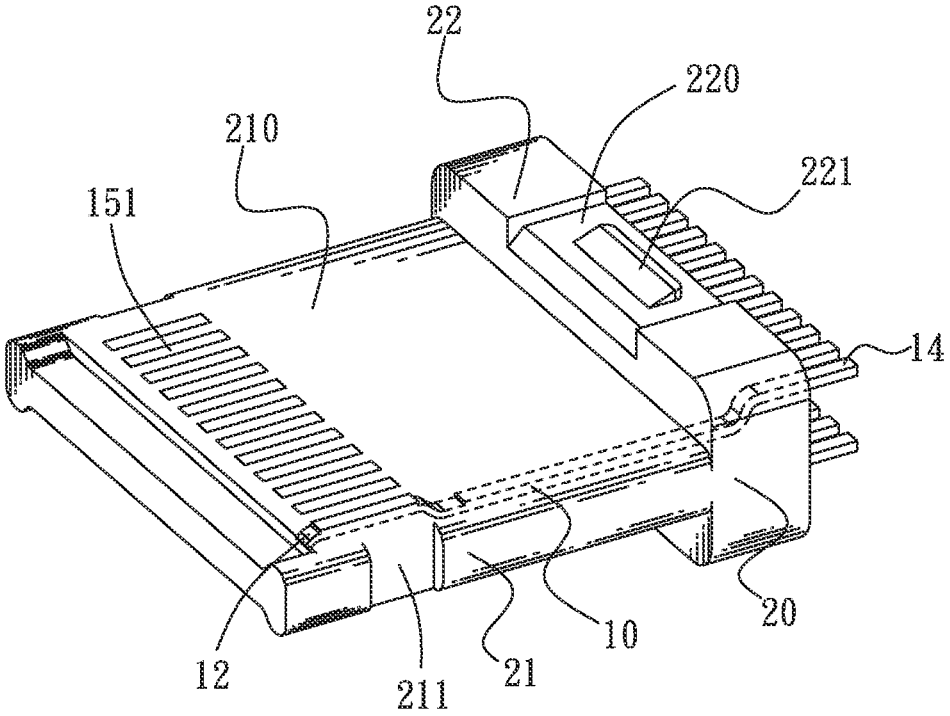
FIG. 3 is an integration perspective view of an insulating body and a plurality of terminals of the electrical connector shown in FIG. 2.
Figure 5:
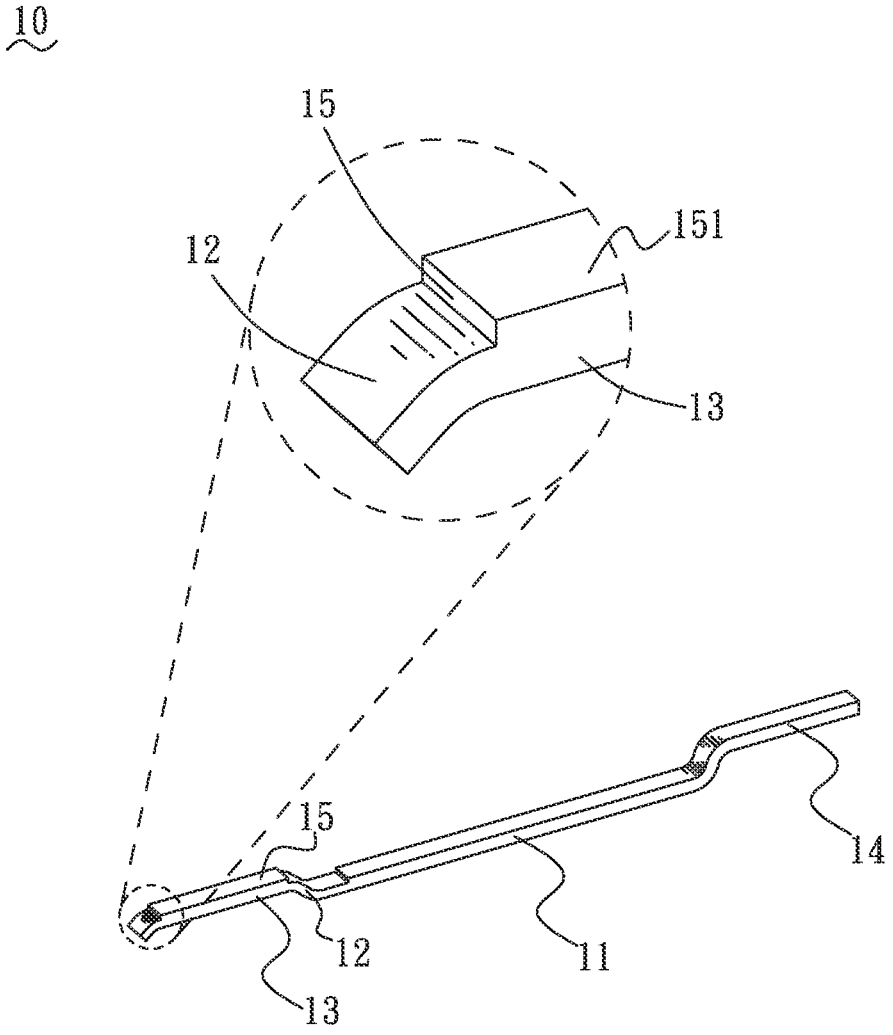
FIG. 5 is a perspective view of the terminal of FIG. 3, wherein a circled part is enlarged.

Referring to FIG. 2, FIG. 3 and FIG. 5, an electrical connector according to an embodiment of the present invention includes an insulating body 20 and a plurality of terminals 10.

At least one of a top face and a bottom face of the insulating body 20 is defined as a mating face 210. The terminals 10 are molded in the insulating body 20 by plastic insert molding. Each of the terminals 10 has a base strip 11 embedded in the insulating body 20. A front end of the base strip 11 is bent towards the mating face 210 to form a bend 12. A free end of the bend 12 extends in a direction substantially parallel to the mating face 210 to form a connecting arm 13. The connecting arm 13 perpendicularly protrudes towards the mating face 210 to form a contact arm 15 extending along a direction of the connecting arm 13. The bend 12, the connecting arm 13 and the contact arm 15 are embedded in the insulating body 20. A face of the contact arm 15 opposite to the connecting arm 13 is defined as a contact face 151 exposed outside the mating face 210 of the insulating body 20. A rear end of the base strip 11 extends to form a soldering tail 14 of which a distal end projects behind the insulating body 20. It is smooth at the connection of the bend 12 and the connecting arm 13 of the terminal 10, and there is a step between the contact face 151 of the contact arm 15 and the bend 12 of the terminal 10.

In manufacture, the terminals 10 are placed in an injection molding machine (not shown) with the contact faces 151 of the contact arms 15 being against an inner side of a shaping cavity (not shown) of the injection molding machine, then plastic material is injected into the injection molding machine to mold the insulating body 20 and the terminals 10 together. In the process of the plastic insert molding, because there is a step between the contact face 151 of the contact arm 15 and the bend 12 of the terminal 10, two opposite end faces of the contact arm 15 are substantially perpendicular to the inner side of the shaping cavity. The plastic material flows along the bend 12 and the connecting arm 13 to gradually accumulate around the contact arm 15. Because the flow direction of the plastic material is substantially vertical to the end faces of the contact arm 15, the plastic material is difficult to burst through the contact face 151 of the contact arm 15 from the inner side of the shaping cavity and flood between the contact face 151 and the inner side of the shaping cavity, so that effectively avoid burrs forming around the contact face 151 and solve injection molding bugs on the electrical connector by virtue of the improved terminal 10.

Figure 6:
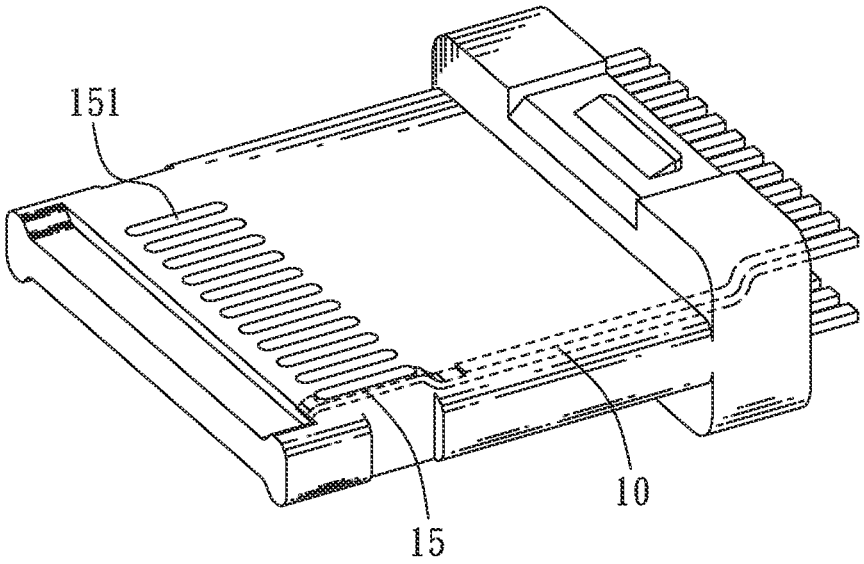
FIG. 6 is an integration perspective view of an insulating body and a plurality of terminals of an electrical connector according to another embodiment of the present invention.
Figure 7:
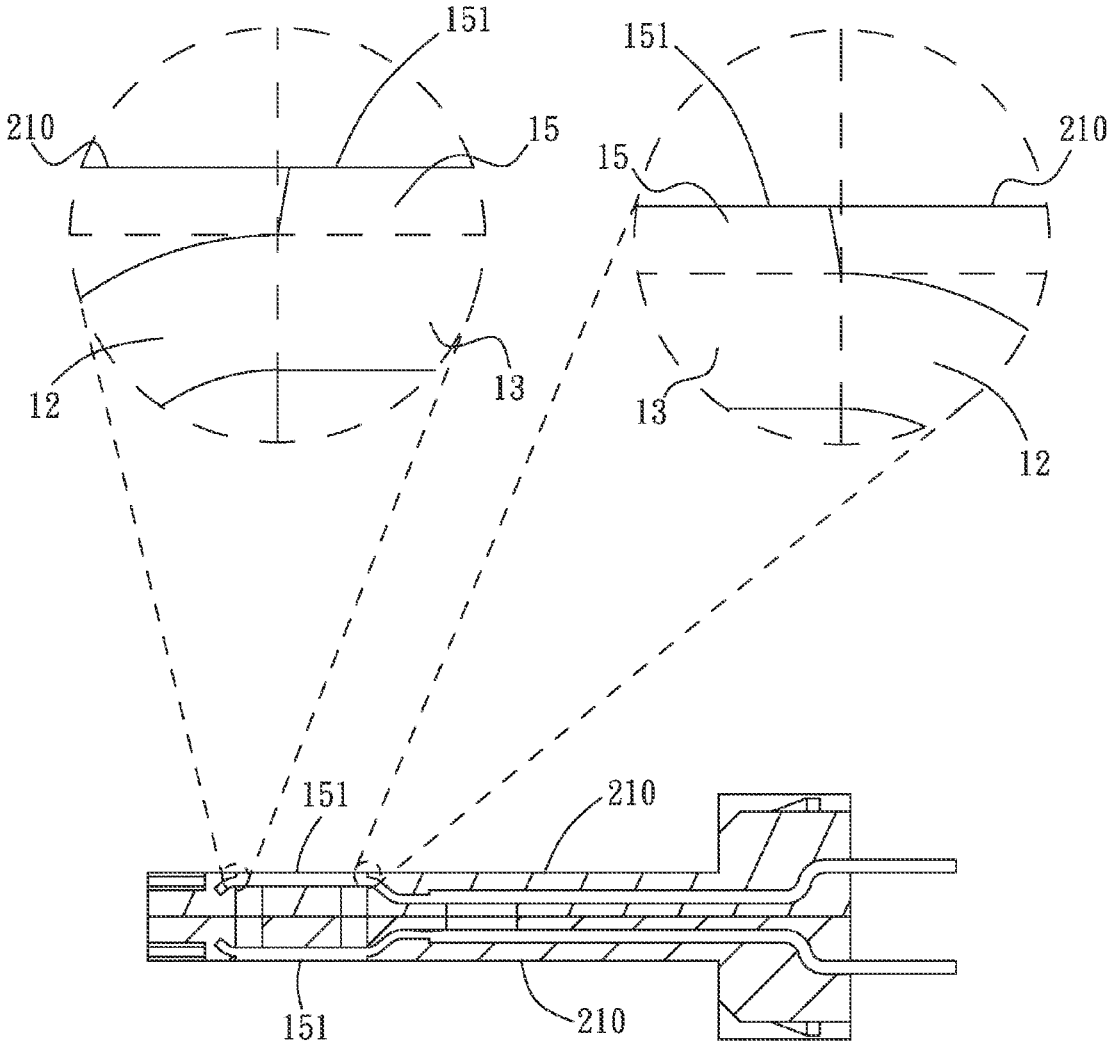
FIG. 7 is a cross-sectional view of the integration of an insulating body and a plurality of terminals of an electrical connector according to another one embodiment of the present invention, wherein two circled parts are enlarged.
Figure 8A:
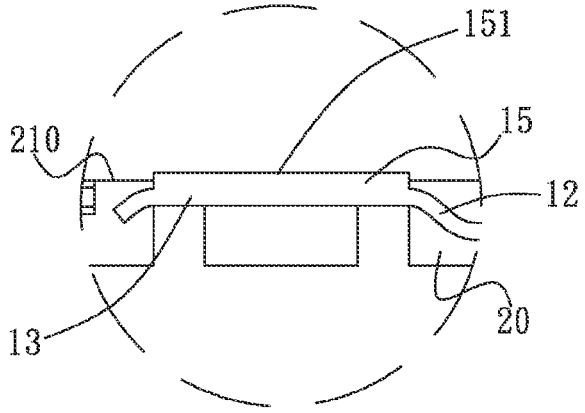
FIG. 8A, FIG. 8B and FIG. 8C are three enlarged views showing another three embodiments of an electrical connector of the present invention.
Figure 8B:
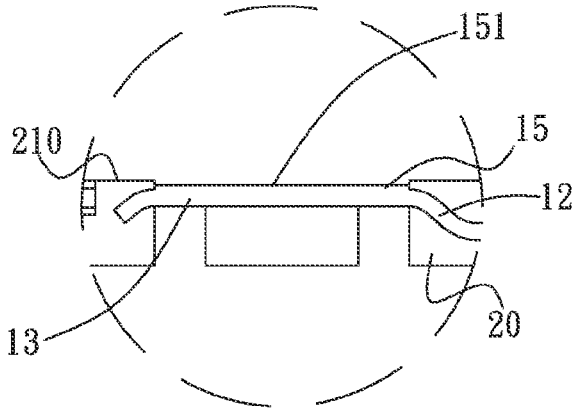
Figure 8C:
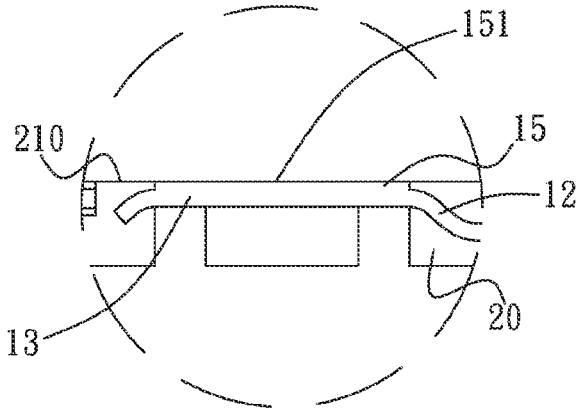

Referring to FIG. 3 and FIG. 6, the contact face 151 of the contact arm 15 of the terminal 10 can be of oblong or ovate-oblong shape. Referring to FIG. 7, there is a 80~100 degree angle between the contact face 151 of the contact arm 15 and each of the two end faces of the contact arm 15. Referring to FIG. 8A, FIG. 8B and FIG. 8C, the contact face 151 of the contact arm 15 can be exposed above or below the mating face 210 of the insulating body 20 or be flush with the mating face 210 of the insulating body 20.

Referring to FIG. 3 and FIG. 5, preferably, a distal end of the connecting arm 13 of the terminal 10 is smoothly curved oppositely to the mating face 210 of the insulating body 20 to form another bend 12 embedded in the insulating body 20. There is a step between the contact face 151 of the contact arm 15 and the bend 12.

Referring to FIG. 3, FIG. 5 and FIG. 7, the insulating body 20 shows a symmetrical structure about a horizontal center plane thereof. The insulating body 20 has a base portion 22 and a tongue portion 21 extending forward from a front side of the base portion 22. Both the top face and the bottom face of the tongue portion 21 are defined as two mating faces 210. The contact arms 15 of the terminals 10 are arranged into two rows in vertical direction and the contact faces 151 are symmetrically exposed outside fronts of the two mating faces 210. In this embodiment, the connecting arm 13 and the soldering tail 14 extend longitudinally towards two opposite directions of the base strip 11. Each row of the contact faces 151 of the contact arms 15 are arranged at regular intervals along a transverse direction of the mating face 210.

Figure 4:
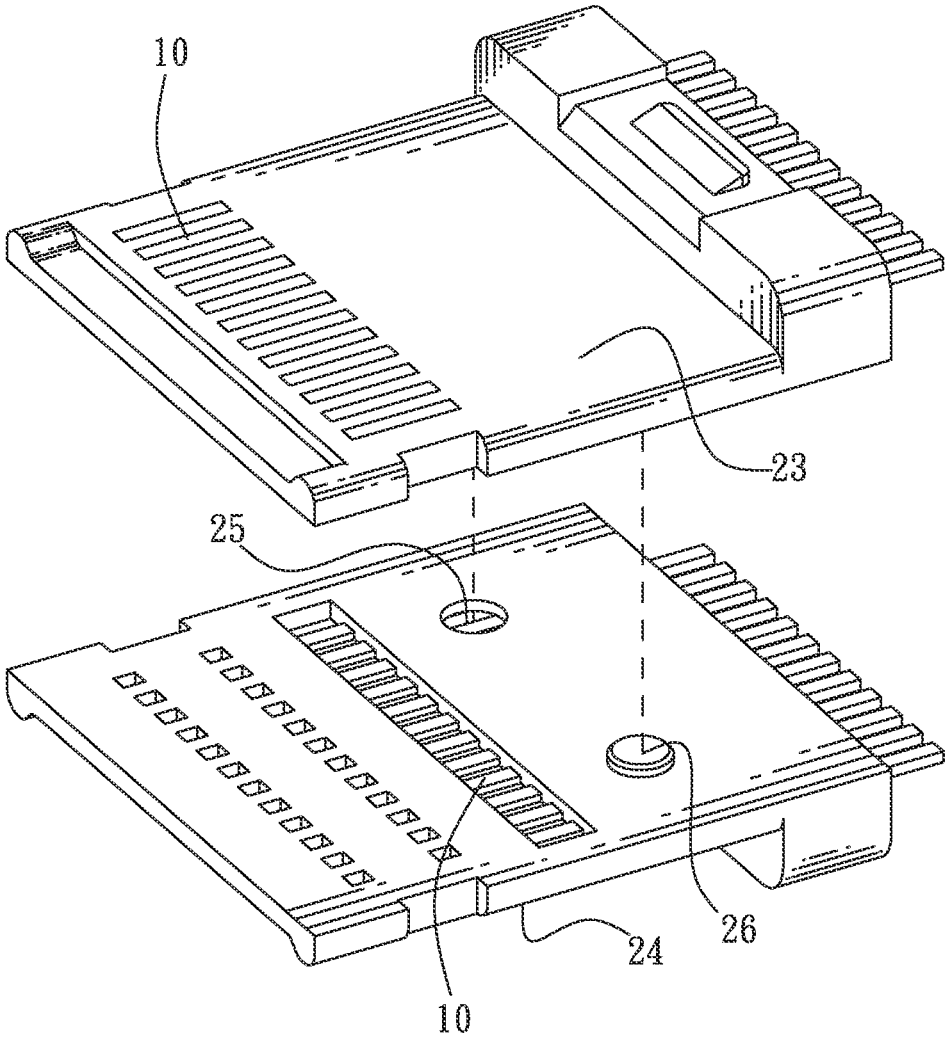
FIG. 4 is a divided perspective view of an upper half body and a lower half body of the insulating body shown in FIG. 3.

Referring to FIG. 3 and FIG. 4, the insulating body 20 is divided along the horizontal center plane thereof into an upper half body 23 and a lower half body 24 which have the same structure. Two face-to-face faces of the upper half body 23 and the lower half body 24 are defined by a pair of buckling grooves 25 and a pair of buckling blocks 26 buckled with one another to make the two face-to-face faces abut against each other. The terminals 10 are divided into two groups symmetrically molded in the upper half body 23 and the lower half body 24. Thereby, it can effectively simplify a mold for molding the insulating body 20 because the upper half body 23 and the lower half body 24 have the same structure, so that effectively simplify the manufacture of the insulating body 20 and make it easier to be reached for molding conditions (after the mold is simplified, the injection force of the plastic material can be accordingly reduced to further avoid burrs forming around the contact faces 151 of the terminals 10).

Figure 9:
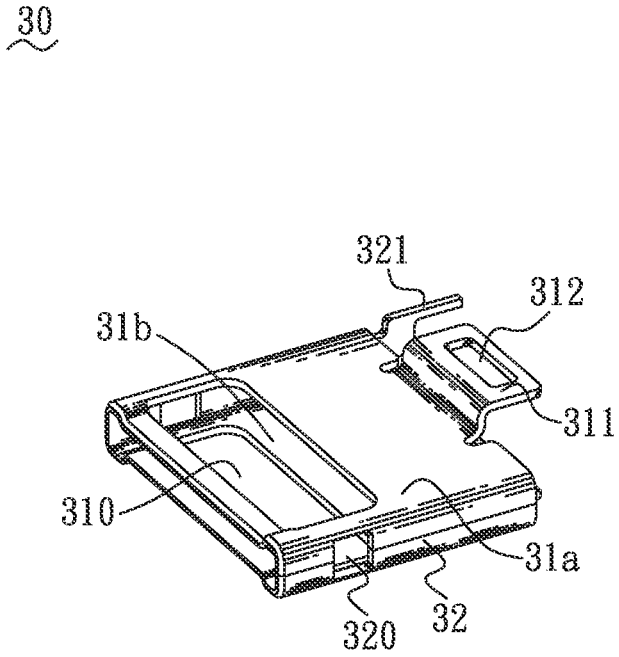
FIG. 9 is a perspective view of a shell of the electrical connector shown in FIG. 2.

Referring to FIG. 2, FIG. 3 and FIG. 9, the electrical connector further includes a shell 30, a printed circuit board 40 and an insulating housing 50. The shell 30 is looped from a meal plate to enclose the tongue portion 21 of the insulating body 20. The printed circuit board 40 is positioned horizontally behind the base portion 22 of the insulating body 20. The soldering tails 14 of the terminals 10 are soldered with a front of the printed circuit board 40. The insulating housing 50 is molded by injection molding to integrate the base portion 22 of the insulating body 20, a rear end of the shell 30 and the printed circuit board 40 therein for the convenience of holding the electrical connector for users.

The shell 30 has a top plate 31*a*, a bottom plate 31*b* and two side plates 32. Fronts of the top plate 31*a* and the bottom plate 31*b* are opened with a pair of windows 310 through which the contact faces 151 of the terminals 10 are exposed outside. Front parts of the top plate 31*a* and the bottom plate 31*b* located in front of the windows 310 are indented towards each other to be embedded in the front of the tongue portion 21 and flush with the mating faces 210 respectively for the convenience of the mating of the electrical connector and an external mating connector (not shown). Two side edges of the tongue portion 21 of the insulating body 20 define a pair of locking gaps 211. The side plates 32 of the shell 30 are opened with a pair of locking holes 320 corresponding to the locking gaps 211 respectively for locking the external mating connector to the electrical connector steadily.

Middles of rear edges of the top plate 31*a* and the bottom plate 31*b* are oppositely bent outward and then extend rearward to form a pair of fastening plates 311 of which each is opened with a fastening hole 312. A top side and a bottom side of the base portion 22 of the insulating body 20 are concaved inward to form two fastening grooves 220 in which a pair of fastening blocks 221 are protruded. The fastening plates 311 are fastened in the fastening grooves 220 and the fastening blocks 221 are buckled in the fastening holes 312, so that make the shell 30 and the insulating body 20 be secured together firmly.

A rear edge of one of the side plates 32 of the shell 30 zigzag extends rearward to form a ground tail 321 of which a distal end projects behind the base portion 22 of the insulating body 20 to be soldered on the front of the printed circuit board 40. The soldering tails 14 of the terminals 10 are arranged into two rows in vertical direction. The front of the printed circuit board 40 is clamped between the two rows of soldering tails 14.

As described above, the contact arm 15 is perpendicularly protruded towards the mating face 210 on the connecting arm 13 to form the step between the contact face 151 and the bend 12, so that effectively avoid burrs forming around the contact face 151 and solve injection molding bugs on the electrical connector. Furthermore, the insulating body 20 shows a symmetrical structure about the horizontal center plane thereof with the contact faces 151 being symmetrically exposed outside the fronts of the two mating faces 210, so users don't need to recognize positive and negative directions of the electrical connector specially when using the electrical connector. It improves the convenience for the users greatly. Moreover, the insulating body 20 is divided along the horizontal center plane thereof into the upper half body 23 and the lower half body 24 which have the same structure, so that not only simplify the manufacture of the insulating body 20, but also further avoid the forming of burrs.

What is claimed is:

1. An electrical connector, comprising:

an insulating body of which at least one of a top face and a bottom face is defined as a mating face; and a plurality of terminals molded in the insulating body by plastic insert molding, each of the terminals having a base strip embedded in the insulating body, a front end of the base strip being bent towards the mating face to form a bend, a free end of the bend extending in a direction substantially parallel to the mating face to form a connecting arm, the connecting arm perpendicularly protruding towards the mating face to form a contact arm extending along a direction of the connecting arm, the bend, the connecting arm and the contact arm being embedded in the insulating body, a face of the contact arm opposite to the connecting arm being defined as a contact face exposed outside the mating face of the insulating body, a rear end of the base strip extending to form a soldering tail of which a distal end projects behind the insulating body;

wherein it is smooth at the connection of the bend and the connecting arm of the terminal, and there is a step between the contact face of the contact arm and the bend of the terminal.

2. The electrical connector as claimed in claim 1, wherein the contact face of the contact arm can be of oblong or ovate-oblong shape.

3. The electrical connector as claimed in claim 1, wherein there is a 80~100 degree angle between the contact face of the contact arm and each of two opposite end faces of the contact arm.

4. The electrical connector as claimed in claim 1, wherein the contact face of the contact arm can be exposed above or below the mating face of the insulating body or be flush with the mating face of the insulating body.

5. The electrical connector as claimed in claim 1, wherein a distal end of the connecting arm is smoothly curved oppositely to the mating face of the insulating body to form another bend embedded in the insulating body, there is a step between the contact face of the contact arm and the bend.

6. The electrical connector as claimed in claim 1, wherein the insulating body shows a symmetrical structure about a horizontal center plane thereof, the insulating body has a base portion and a tongue portion extending forward from a front side of the base portion, both the top face and the bottom face of the tongue portion are defined as two mating faces, the contact arms of the terminals are arranged into two rows in vertical direction and the contact faces are symmetrically exposed outside fronts of the two mating faces.

7. The electrical connector as claimed in claim 6, wherein the connecting arm and the soldering tail extend longitudinally towards two opposite directions of the base strip, each row of the contact faces of the contact arms are arranged at regular intervals along a transverse direction of the mating face.

8. The electrical connector as claimed in claim 6, wherein the insulating body is divided along the horizontal center plane thereof into an upper half body and a lower half body which have the same structure, two face-to-face faces of the upper half body and the lower half body are defined by a pair of buckling grooves and a pair of buckling blocks buckled with one another to make the two face-to-face faces abut against each other, the terminals are divided into two groups symmetrically molded in the upper half body and the lower half body.

9. The electrical connector as claimed in claim 6, further comprising:

a shell looped from a meal plate to enclose the tongue portion of the insulating body;

a printed circuit board positioned horizontally behind the base portion of the insulating body, the soldering tails of the terminals being soldered with a front of the printed circuit board; and an insulating housing molded by injection molding to integrate the base portion of the insulating body, a rear end of the shell and the printed circuit board therein.

10. The electrical connector as claimed in claim 9, wherein the soldering tails of the terminals are arranged into two rows in vertical direction, the front of the printed circuit board is clamped between the two rows of soldering tails.

11. The electrical connector as claimed in claim 9, wherein the shell has a top plate, a bottom plate and two side plates, fronts of the top plate and the bottom plate are opened with a pair of windows through which the contact faces of the terminals are exposed outside, front parts of the top plate and the bottom plate located in front of the windows are indented towards each other to be embedded in the front of the tongue portion and flush with the mating faces respectively.

12. The electrical connector as claimed in claim 11, wherein two side edges of the tongue portion of the insulating body define a pair of locking gaps, the side plates of the shell are opened with a pair of locking holes corresponding to the locking gaps respectively.

13. The electrical connector as claimed in claim 11, wherein middles of rear edges of the top plate and the bottom plate are oppositely bent outward and then extend rearward to form a pair of fastening plates of which each is opened with a fastening hole, a top side and a bottom side of the base portion of the insulating body are concaved inward to form two fastening grooves in which a pair of fastening blocks are protruded, the fastening plates are fastened in the fastening grooves and the fastening blocks are buckled in the fastening holes.

14. The electrical connector as claimed in claim 11, wherein a rear edge of one of the side plates zigzag extends rearward to form a ground tail of which a distal end projects behind the base portion of the insulating body to be soldered on the front of the printed circuit board.

* * * * *